US011460210B2

(12) United States Patent
Oh et al.

(10) Patent No.: US 11,460,210 B2
(45) Date of Patent: Oct. 4, 2022

(54) AIR CONDITIONING DEVICE AND CONTROL METHOD THEREOF

(71) Applicant: Samsung Electronics Co., Ltd., Suwon-si (KR)

(72) Inventors: Seungwon Oh, Suwon-si (KR); Jun Hwang, Suwon-si (KR); Younghoon Kim, Suwon-si (KR); Hyeongjoon Seo, Suwon-si (KR); Sunhee Son, Suwon-si (KR); Youngju Joo, Suwon-si (KR); Hyoungseo Choi, Suwon-si (KR); Jongkweon Ha, Suwon-si (KR); Soonhoon Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/114,992

(22) Filed: Dec. 8, 2020

(65) Prior Publication Data

US 2021/0180825 A1 Jun. 17, 2021

(30) Foreign Application Priority Data

Dec. 12, 2019 (KR) ..... 10-2019-0165853

(51) Int. Cl.
*F24F 11/74* (2018.01)
*F24F 11/67* (2018.01)
*F24F 120/12* (2018.01)

(52) U.S. Cl.
CPC ..... *F24F 11/74* (2018.01); *F24F 11/67* (2018.01); *F24F 2120/12* (2018.01)

(58) Field of Classification Search
CPC ..... F24F 11/74; F24F 11/67; F24F 2120/12
See application file for complete search history.

(56) References Cited

U.S. PATENT DOCUMENTS

| | | | | |
|---|---|---|---|---|
| 4,815,657 | A * | 3/1989 | Tsukuda | G05D 23/1902 165/11.1 |
| 10,132,666 | B2 | 11/2018 | Lee et al. | |
| 10,871,302 | B2 * | 12/2020 | Song | F24F 11/65 |
| 2005/0229610 | A1 * | 10/2005 | Park | F24F 1/005 62/126 |
| 2016/0150925 | A1 * | 6/2016 | Takei | B01D 46/442 15/301 |
| 2016/0341603 | A1 * | 11/2016 | Kusukame | G01J 5/00 |
| 2018/0142911 | A1 * | 5/2018 | Zhang | F24F 3/16 |
| 2018/0149377 | A1 * | 5/2018 | Hale | F24F 11/77 |

(Continued)

FOREIGN PATENT DOCUMENTS

| | | | |
|---|---|---|---|
| JP | 2001005973 A | * | 1/2001 |
| JP | 2012-017936 A | | 1/2012 |

(Continued)

OTHER PUBLICATIONS

International Search Report dated Mar. 5, 2021, issued in International Patent Application No. PCT/KR2020/016254.

*Primary Examiner* — Nelson J Nieves
(74) *Attorney, Agent, or Firm* — Jefferson IP Law, LLP

(57) ABSTRACT

An air conditioning device is provided. The air conditioning device includes an image sensor, and a processor configured to identify an object based on edge information included in an image acquired through the image sensor, and control an operation of the air conditioning device based on the type information of the identified object.

18 Claims, 14 Drawing Sheets

(56) References Cited

U.S. PATENT DOCUMENTS

| | | | | |
|---|---|---|---|---|
| 2019/0049140 | A1* | 2/2019 | Arakaki | F24F 11/89 |
| 2019/0063776 | A1* | 2/2019 | Michimori | F24F 11/66 |
| 2019/0285307 | A1* | 9/2019 | Sugiyama | F24F 11/79 |
| 2020/0003441 | A1* | 1/2020 | Brahme | F24F 11/86 |
| 2020/0217550 | A1* | 7/2020 | Boyd | F24F 11/74 |
| 2020/0240658 | A1* | 7/2020 | Kitagawa | F24F 11/56 |
| 2020/0240670 | A1* | 7/2020 | Kitagawa | B60H 1/00 |
| 2021/0000996 | A1* | 1/2021 | Kitagawa | G10L 25/51 |
| 2021/0190357 | A1* | 6/2021 | Ishizaka | F24F 11/54 |
| 2021/0222906 | A1* | 7/2021 | Imai | F24F 11/72 |
| 2021/0318018 | A1* | 10/2021 | Kitagawa | F24F 11/63 |
| 2021/0333004 | A1* | 10/2021 | Haghayeghi | F24F 11/526 |
| 2021/0356161 | A1* | 11/2021 | Chen | F24F 11/64 |

FOREIGN PATENT DOCUMENTS

| | | | |
|---|---|---|---|
| JP | 2012-037176 | A | 2/2012 |
| JP | 5144446 | B2 | 2/2013 |
| JP | 2013-108671 | A | 6/2013 |
| JP | 2016-044827 | A | 4/2016 |
| KR | 10-2014-0031081 | A | 3/2014 |
| KR | 10-1523424 | B1 | 5/2015 |
| KR | 10-1724788 | B1 | 4/2017 |
| KR | 10-1730999 | B1 | 4/2017 |
| KR | 10-2018-0051729 | A | 5/2018 |
| KR | 10-2019-0026519 | A | 3/2019 |
| KR | 10-2019-0035007 | A | 4/2019 |
| KR | 10-1980906 | B1 | 5/2019 |
| WO | 03/105406 | A1 | 12/2003 |

* cited by examiner

AIR CONDITIONING DEVICE AND CONTROL METHOD THEREOF

CROSS-REFERENCE TO RELATED APPLICATION(S)

This application is based on and claims priority under 35 U.S.C. § 119(a) of a Korean patent application number 10-2019-0165853, filed on Dec. 12, 2019, in the Korean Intellectual Property Office, the disclosure of which is incorporated by reference herein in its entirety.

BACKGROUND

1. Field

The disclosure relates to an air conditioning device that performs an air conditioning operation based on information on an identified object, and a control method thereof.

2. Description of Related Art

With the development of air conditioning technologies and construction of an Internet of Things (IoT) environment connected through a wireless communication network, a current air conditioning device is able to provide a more pleasant indoor environment to a user than an air conditioning device by utilizing information collected through a wireless communication network and a sensor, etc., without intervention of a user.

Meanwhile, for providing a pleasant indoor environment, it is necessary to identify information on an indoor environment, and in this case, a process of analyzing an image acquired through a camera provided on an air conditioning device is needed.

Meanwhile, in an image acquired through a camera, figures such as a person who lives indoors may be included, for example, and in this regard, there is a problem regarding protection of privacy.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an air conditioning device for which the problem of privacy of an indoor image photographed for providing a pleasant indoor environment has been reduced, and a control method thereof.

Additional aspects will be set forth in part in the description which follows and, in part, will be apparent from the description, or may be learned by practice of the presented embodiments.

In accordance with an aspect of the disclosure, an air conditioning device for achieving the aforementioned purpose is provided. The air conditioning device includes an image sensor, and a processor configured to identify an object based on edge information included in an image acquired through the image sensor, and control an operation of the air conditioning device based on the type information of the identified object.

In accordance with another aspect of the disclosure, a control method of an air conditioning device is provided. The control method of an air conditioning device includes the steps of identifying an object based on edge information included in an image acquired through an image sensor, and controlling an operation of the air conditioning device based on the type information of the identified object.

As described above, according to the various embodiments of the disclosure, the problem of privacy of an indoor image photographed for providing a pleasant indoor environment can be reduced.

Also, an air conditioning device can identify indoor environment information correctly from an image for which the problem of privacy has been reduced, and provide a pleasant environment that suits an indoor space and a situation.

In addition, as an air conditioning mode, etc., are changed according to the amount of activity and the state of absence of an identified object, power consumption can be reduced.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
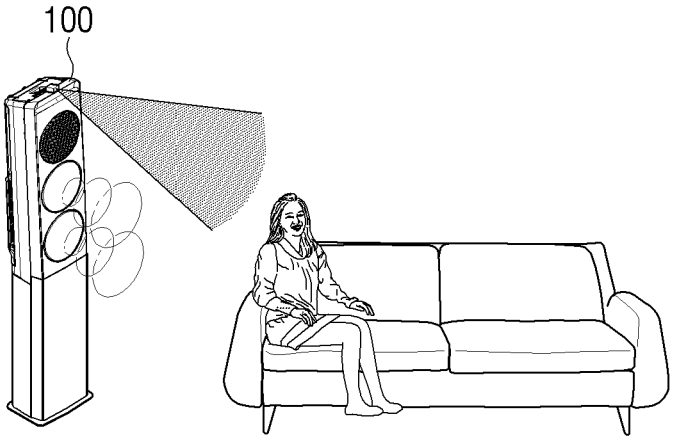
FIG. 1 is a diagram for illustrating an operation of identifying a state of an indoor environment briefly according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Meanwhile, singular expressions include plural expressions, unless defined obviously differently in the context. In addition, in the disclosure, terms such as "include" and "consist of" should be construed as designating that there are such characteristics, numbers, steps, operations, elements, components or a combination thereof described in the specification, but not as excluding in advance the existence or possibility of adding one or more of other characteristics, numbers, steps, operations, elements, components or a combination thereof.

Also, the expression "at least one of A and/or B" should be interpreted to mean any one of "A" or "B" or "A and B."

In addition, the expressions "first," "second" and the like used in this specification may be used to describe various elements regardless of any order and/or degree of importance. Also, such expressions are used only to distinguish one element from another element, and are not intended to limit the elements.

Further, the description in the disclosure that one element (e.g.: a first element) is "(operatively or communicatively) coupled with/to" or "connected to" another element (e.g.: a second element) should be interpreted to include both the case where the one element is directly coupled to the another element, and the case where the one element is coupled to the another element through still another element (e.g.: a third element).

Also, in the disclosure, "a module" or "a part" performs at least one function or operation, and may be implemented as hardware or software, or as a combination of hardware and software. Further, a plurality of "modules" or "parts" may be integrated into at least one module and implemented as at least one processor (not shown), except "modules" or "parts" which need to be implemented as specific hardware. In addition, in this specification, the term "user" may refer to a person who uses an electronic device or a device using an electronic device (e.g.: an artificial intelligence electronic device).

Hereinafter, the embodiments of the disclosure will be described in detail with reference to the accompanying drawings, such that those having ordinary skill in the art to which the disclosure belongs can easily carry out the disclosure. However, it should be noted that the disclosure may be implemented in various different forms, and is not limited to the embodiments described herein. Also, in the drawings, parts that are not related to explanation were omitted, for explaining the disclosure clearly, and throughout the specification, similar components were designated by similar reference numerals.

Hereinafter, embodiments of the disclosure will be described in more detail with reference to the accompanying drawings.

FIG. 1 is a diagram for illustrating an operation of identifying a state of an indoor environment briefly according to an embodiment of the disclosure.

Referring to FIG. 1, an air conditioning device 100 may be a device for improving an air environment to be pleasant. The air conditioning device 100 may be implemented as an air conditioner, an air purifier, a humidifier, a dehumidifier, an air blower, etc., but the air conditioning device 100 is not limited thereto, and it may be implemented as various devices that can perform cooling, heating, air purification, dehumidification, and humidification functions. However, hereinafter, explanation will be made based on the assumption of a case wherein the air conditioning device 100 is implemented as an air conditioner, for the convenience of explanation.

The air conditioning device 100 may identify an indoor environment state and perform an optimal air conditioning operation based on the identified environment state, and in this case, an image acquired through an image sensor may be used for identifying an indoor environment state.

However, a problem of privacy may occur by an image acquired through an image sensor, and hereinafter, various embodiments of the disclosure wherein an indoor environment state is identified by using an image including only contour lines (edges) of an object but not an image photographed for reducing the problem of privacy itself will be described.

Figure 2:
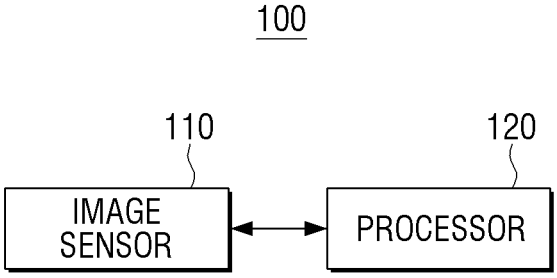
FIG. 2 is a block diagram for illustrating an operation of an air conditioning device according to an embodiment of the disclosure.

FIG. 2 is a block diagram for illustrating an operation of an air conditioning device according to an embodiment of the disclosure.

Referring to FIG. 2, the air conditioning device 100 includes an image sensor 110 and a processor 120.

The image sensor 110 may convert a light that is incident through a lens into an electronic image signal and acquire a photographing image. In other words, the image sensor 110 is a component acquiring an image.

According to an embodiment of the disclosure, the image sensor 110 may be implemented as a dynamic vision sensor (DVS) that is a sensor detecting an edge area of an object based on a light reflected from the object according to a movement of the object. In this case, the object having a movement is displayed on an image, and on the image, only the contour lines (edges) of the object may be displayed. In other words, an image acquired through a DVS may be a binary image including only the contour lines of a moving object.

However, the disclosure is not limited thereto, and the image sensor 110 may be implemented as a complementary metal oxide semiconductor (CMOS) sensor, a charge coupled device (CCD) sensor, etc., and in this case, an image acquired through the image sensor 110 may not be a binary image, but may be a general image that displays an actual environment as it is. The processor 120 may perform edge detection processing for such an image and acquire a binary image having only contour lines. Detailed explanation in this regard will be made below.

As described above, the air conditioning device 100 identifies an indoor environment state by using a binary image, and thus the problem of privacy can be reduced.

Meanwhile, depending on cases, information on an object may be identified through an infrared sensor detecting infrared rays emitted from an object, but not through an image sensor. In this case, the infrared sensor may be implemented as a passive infrared (PIR) sensor.

The processor 120 controls the overall operations of the air conditioning device 100.

According to an embodiment of the disclosure, the processor 120 may be implemented as a digital signal processor (DSP) processing digital signals, a microprocessor, and a time controller (TCON). However, the disclosure is not limited thereto, and the processor 120 may include one or more of a central processing unit (CPU), a micro controller unit (MCU), a micro processing unit (MPU), a controller, an application processor (AP) or a communication processor (CP), an ARM processor, or an artificial intelligence (AI) processor, or may be defined by the terms. Also, the processor 120 may be implemented as a system on chip (SoC) having a processing algorithm stored therein or large scale integration (LSI), or in the form of a field programmable gate array (FPGA). The processor 120 may perform various functions by executing computer executable instructions stored in a memory (not shown).

According to an embodiment of the disclosure, the processor 120 may identify an object based on edge information included in an image acquired through the image sensor 110.

According to an embodiment of the disclosure, the processor 120 may acquire an image including edge information through a dynamic vision sensor (DVS) that is a sensor detecting an edge area of an object based on a light reflected from the object according to a movement of the object. In other words, the processor 120 may acquire an image including edge information from the image sensor 110 without a separate processing process. An image including edge information is an image including only the contour lines of a moving object, and it may be a binary image. For example, the background of an image including edge information may be in a black color, and only the contour lines of an object may be displayed in a white color. In an image including edge information as described above, only limited information (e.g., edge information) is included compared to an image acquired through a complementary metal oxide semiconductor (CMOS) sensor, in general. Thus, the problem regarding protection of privacy can be reduced.

Meanwhile, the processor 120 may acquire information on an object from an image including edge information through a neural network model stored in a memory (not shown). Specifically, the processor 120 may input an acquired image (an image including edge information) into a neural network model, and acquire the type information of an object output from the neural network model.

The neural network model may be a model trained to identify the type of an object based on an input image including edge information. The neural network model may consist of a plurality of neural network layers. Each of the plurality of neural network layers has a plurality of weight values, and performs a neural network operation through an operation between the operation result of the previous layer and the plurality of weight values. The plurality of weight values that the plurality of neural network layers have may be optimized by a learning result of the neural network model. For example, the plurality of weight values may be updated such that a loss value or a cost value acquired from the neural network model during a learning process is reduced or minimized. An artificial neural network may include a deep neural network (DNN), and there are, for example, a convolutional neural network (CNN), a deep neural network (DNN), a recurrent neural network (RNN), a restricted Boltzmann Machine (RBM), a deep belief network (DBN), a bidirectional recurrent deep neural network (BRDNN), or a deep Q-network, etc., but the disclosure is not limited to the aforementioned examples.

Also, the neural network model may have been trained through the air conditioning device 100 or a separate server/system through various learning algorithms. A learning algorithm is a method of training a specific subject device by using a plurality of learning data and thereby enabling the specific subject device to make a decision or make a prediction by itself. As examples of learning algorithms, there are supervised learning, unsupervised learning, semi-supervised learning, or reinforcement learning, but learning algorithms in the disclosure are not limited to the aforementioned examples except specified cases.

For example, the processor 120 may train the neural network model by using an image including edge information and label information that the image falls under a person in case the type of an object is a person as learning data for the neural network model. Label information means explicit correct answer information for input data. Also, the processor 120 may train the neural network model by using an image including edge information and label information that the image falls under a specific animal in case the type of an object is an animal as learning data for the neural network model.

Specifically, the neural network model may output the type information of an animal included in an input image through learning. For example, the processor 120 may train the neural network model by using an image including edge information and label information that the image falls under a dog in case the type of an object is a dog as learning data for the neural network model, and may train the neural network model by using an image including edge information and label information that the image falls under a cat in case the type of an object is a cat as learning data for the neural network model.

Also, the neural network model may output the size information of an object included in an image. For example, in case the type of an object is identified as a dog and the size information is also output through the neural network model, the processor 120 may acquire the type information of the object by distinguishing the object into a large-sized dog, a medium-sized dog, and a small-sized dog based on the type information and the size information. Also, the neural network model may distinguish the detailed breed of an animal Meanwhile, depending on cases, in case the type of an object is not clearly identified through the neural network model, the processor 120 may provide an acquired image through a display (not shown), and request an input regarding the type information of an object to a user. In case a feedback for the type information of an object is input from a user in response thereto, the neural network model may learn by using the image and the type information of an object as learning data.

As described above, if an image is input into the trained neural network model, the neural network model may output the type of each object included in the input image as a probability value. For example, regarding a specific object included in an image, the neural network model may generate probability values for the type of the object, like the probability of the object being a person as 0.9, the probability of the object being a dog as 0.05, and the probability of the object being a cat as 0.05. The neural network model may output information having the highest probability value among the generated probability values as the type information of the object.

Accordingly, the processor 120 may acquire the type information of an object based on information output from the neural network model.

Afterwards, the processor 120 may control the operation of the air conditioning device 100 based on the type information of the identified object.

As an example, the processor 120 may control at least one of an air conditioning mode or the strength of air conditioning based on the type information of an object. Specifically, the processor 120 may control at least one of a cooling mode or a heating mode, the strength of wind for cooling or heating, the location of wind for cooling or heating, or the angle of wind for cooling or heating based on the type information of an object. Detailed explanation in this regard will be made in FIGS. 5A to 5D.

FIGS. 5A to 5D are diagrams for illustrating an operation of controlling the air conditioning device based on the type information of an object according to various embodiments of the disclosure. A case wherein the air conditioning device 100 in FIG. 5A to FIG. 5D is implemented as an air conditioner, and the air conditioner has three wind doors in a vertical direction is assumed. Each wind door may include a fan generating air currents.

Figure 5A:
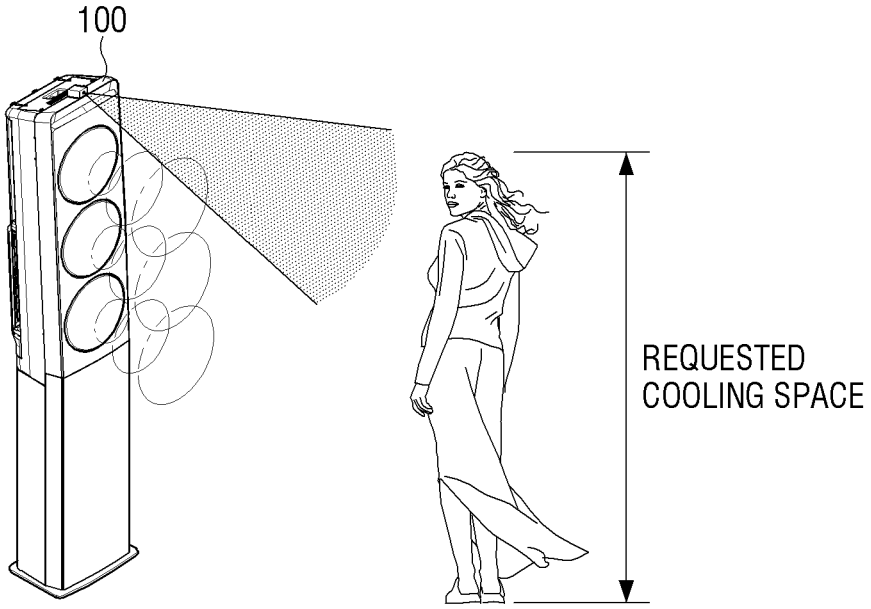
FIG. 5A is a diagram for illustrating control of an air conditioning device in case a type of an object is a person according to an embodiment of the disclosure.

FIG. 5A is a diagram for illustrating control of an air conditioning device in case the type of an object is a person according to an embodiment of the disclosure.

Referring to FIG. 5A, a case wherein information that the type of an object is a person is output from an image including edge information through the neural network model is assumed. As an example, an actual living space of a person may be 1.8 meters (m) from the bottom. Accordingly, in case the type information of an object identified from an image is a person, the processor 120 may use all of the three wind doors to output wind based on the actual living space of the person. In other words, the processor 120 outputs wind through all of the three wind doors, and thus the strength of air conditioning may be relatively high. That is, the location of wind for cooling or heating may be determined based on the type information of an object. The location of wind may correspond to the location of a wind door through which wind is output in the air conditioning device 100.

Meanwhile, the processor 120 does not control the air conditioning device limited to the type information of an object, and for example, even if the type information of an object included in an image is identified as a person, in case the person is sitting or lying, the processor 120 may control the air conditioning device based on the state information of the object like outputting wind through wind doors in a number of smaller than three. For example, in case the time that an object is identified as lying is greater than or equal to a predetermined time, the processor 120 may identify that the object is in a sleeping state and change the air conditioning mode from a general mode to a windless mode. The general mode is a mode having a tendency of high speed cooling, and the indoor temperature may reach a set desired temperature within a relatively short time. The windless mode is a mode having a tendency of low speed cooling, and the indoor temperature may reach a set desired temperature within a relatively long time. According to the air conditioning mode as above, the strength of wind for cooling or heating may be determined.

Figure 5B:
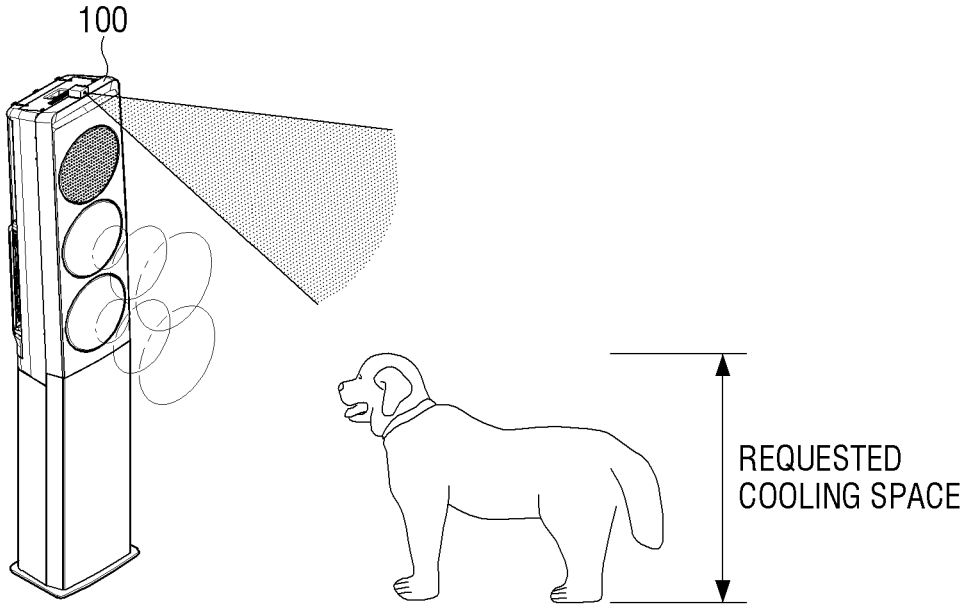
FIG. 5B is a diagram for illustrating control of an air conditioning device in case a type of an object is an animal according to an embodiment of the disclosure.
Figure 5C:
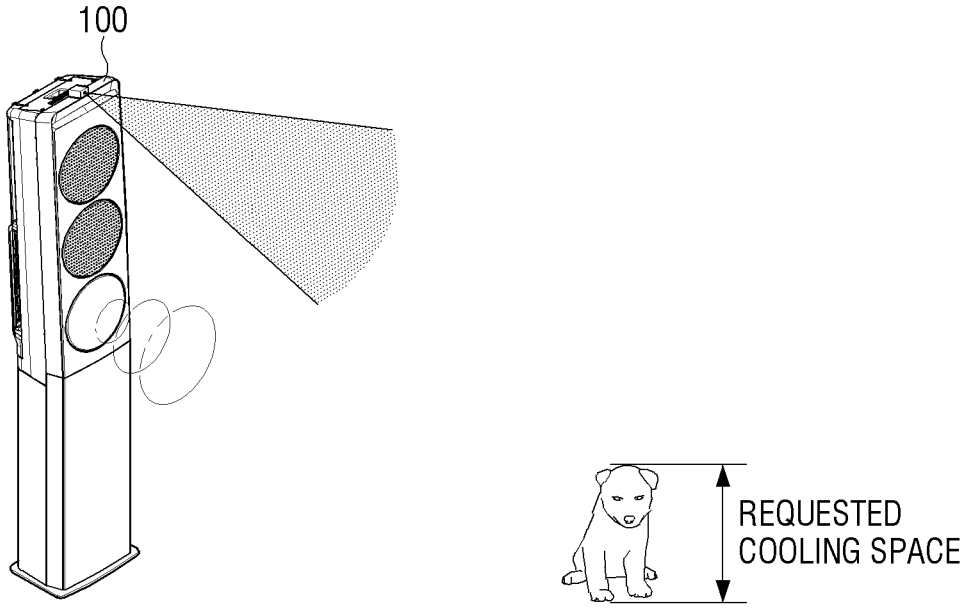
FIG. 5C is a diagram for illustrating control of an air conditioning device in case a type of an object is an animal according to an embodiment of the disclosure.

FIG. 5B and FIG. 5C are diagrams for illustrating control of an air conditioning device in case the type of an object is an animal according to various embodiments of the disclosure.

Referring to FIG. 5B, a case wherein information that the type of an object is an animal is output from an image including edge information through the neural network model is assumed. As an example, a case wherein the animal is identified as a large-sized dog is assumed. In this case, the processor 120 may use the two wind doors in the lower part adjacent to the bottom such that wind is output based on the actual living space of the large-sized dog. In other words, the processor 120 may output wind through the two wind doors in the lower part.

Referring to FIG. 5C, a case wherein information that the type of an object is an animal is output from an image including edge information through the neural network model is assumed. As an example, a case wherein the animal is identified as a small-sized dog is assumed. In this case, the processor 120 may use one wind door in the lower part adjacent to the bottom such that wind is output based on the actual living space of the small-sized dog. In other words, the processor 120 outputs wind through one wind door in the lower part, and thus the strength of air conditioning may be relatively low.

Meanwhile, in case the breed of an animal is identified through the neural network model, the processor 120 may control the operation of the air conditioning device 100 based on the information of the breed. For example, if the type of an identified object is a specific breed of dogs, and it is identified that the breed is suitable for a low temperature based on the information of the breed, the processor 120 may reduce the indoor temperature by lowering the desired temperature of the air conditioning device 100. The information of the breed may be information stored in the memory (not shown) or received from an external server.

Figure 5D:
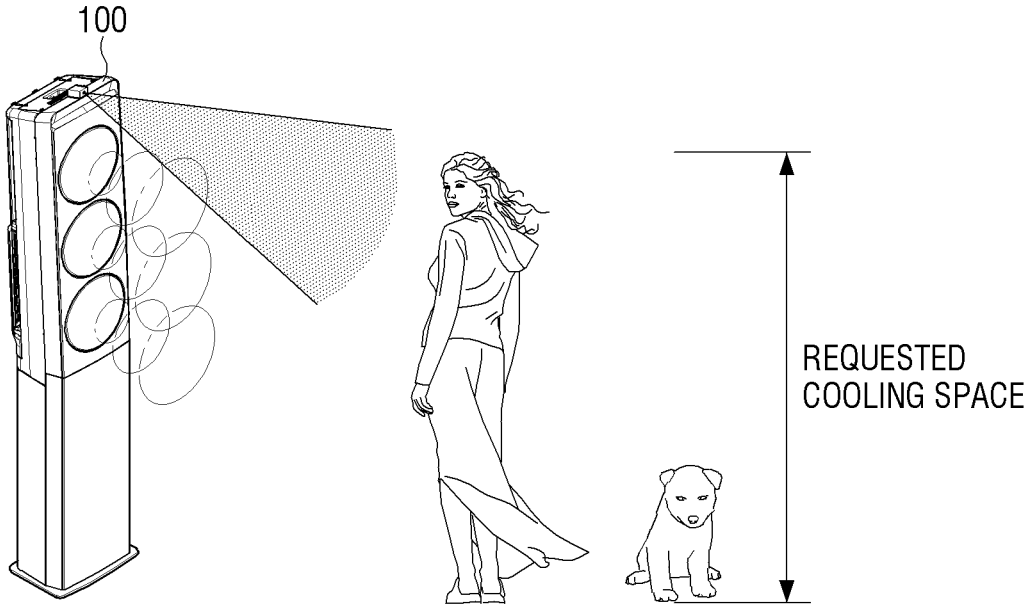
FIG. 5D is a diagram for illustrating control of an air conditioning device in case different types of objects are included in an image according to an embodiment of the disclosure.

FIG. 5D is a diagram for illustrating control of the air conditioning device in case different types of objects are included in an image according to an embodiment of the disclosure.

The type information of objects may include a first type and a second type having different priorities. The priority information of each type may be generated by a setting by a user or a predefined value, and may be stored in the memory (not shown). For example, in a predefined value, the top priority may be granted to the object type of a person.

If an object of the first type and an object of the second type are identified in an image including an edge area, the processor 120 may control the air conditioning operation based on the first type having the relatively higher priority.

Referring to, FIG. 5D a case wherein information that the types of objects are a person and a dog (a small-sized dog) is output from an image including edge information through the neural network model is assumed. As an example, in case the type information of the objects is based on the person, the processor 120 may use all of the three wind doors to output wind based on the actual living space of the person, and in case the type information of the objects is based on the small-sized dog, the processor 120 may use one wind door in the lower part based on the actual living space of the small-sized dog. In this case, the processor 120 may control the air conditioning operation based on the person which is the object information having the relatively higher priority based on the priority information. Accordingly, even though a small-sized dog was identified together in an image including edge information, the air conditioning operation may be performed on the basis of the person based on the priority information.

Meanwhile, it was described above that the number of the wind doors or the locations of the wind doors through which wind is output is determined based on the type information of an object, but the disclosure is not limited thereto, and the processor 120 may determine the angle of output wind based on the type information of an object. For example, in case the type information of an object is a person, the processor 120 may increase the angle of wind such that wind can be transmitted to the upper area of the indoor space, and in case the type information of an object is a small-sized dog, the processor 120 may decrease the angle of wind such that wind can be transmitted to the lower area of the indoor space. It is obvious that the angle of wind can be changed to the left side and the right side.

Referring to FIG. 2 again, the processor 120 may acquire additional information for at least one of the number of objects, the sizes of objects, the amount of activity of objects, or the locations of objects based on an image acquired from the image sensor 110. Afterwards, the processor 120 may control the operation of the air conditioning device based on the type information of the objects and the additional information.

The processor 120 may acquire information on the amount of activity of an object based on the degree that edges (contour lines) included in an image are changed. Edge information is information generated based on a light reflected from a moving object, and accordingly, as the amount of activity of an object is higher, the degree of change of edges may be bigger. Accordingly, if it is identified that the amount of activity of an object is high, the processor 120 may increase the strength of air conditioning, and if it is identified that the amount of activity of an object is low, the processor 120 may decrease the strength of air conditioning. The amount of activity may be distinguished according to a predetermined threshold value, and there may be a plurality of threshold values. For example, in case information on the amount of activity is smaller than a first threshold value, the processor 120 may output wind through one wind door, and in case information on the amount of activity is greater than or equal to the first threshold value and smaller than a second threshold value, the processor 120 may output wind through two wind doors, and in case information on the amount of activity is greater than or equal to the second threshold value, the processor 120 may output wind through three wind doors. Also, the processor 120 may determine the air conditioning mode based on the information on the amount of activity. For example, in case the information on the amount of activity is relatively low, the processor 120 may change the air conditioning mode to a windless mode, and in case the information on the amount of activity is relatively high, the processor 120 may change the air conditioning mode to a general mode.

Also, in case an object is located in a relatively far distance from the image sensor 110 provided on the air conditioning device 100, the processor 120 may output wind through a wind door in the upper part, and in case an object is located in a relatively close distance from the image sensor 110, the processor 120 may output wind through a wind door in the lower part.

In addition, as the indoor temperature may rise if the number of objects is identified to be greater than or equal to a threshold number, the processor 120 may increase the strength of air conditioning.

Also, as described above, the operation of the air conditioning device 100 may be changed according to the size of an object such as a large-sized dog and a small-sized dog.

Meanwhile, in case an amount of activity is not detected during a threshold time, i.e., in case an object is not identified from an image, the processor 120 may identify that it is an absence state of an object, and control the air conditioning device 100 to correspond thereto. For example, in case a separate object is not identified during one hour in an image acquired from the image sensor 110, the processor 120 may change the air conditioning mode to a windless mode or turn off the air conditioning device 100. A state wherein an object is not identified from an image during a predetermined time is determined as an absence state of an object, and thus it is desirable that the processor 120 changes the air conditioning device 100 to a windless mode wherein low power is consumed or turn off the air conditioning device 100.

Also, if an object is not identified during a threshold time and then an object is identified, the processor 120 may control the speaker (not shown) to output indoor environment information including at least one of the temperature, the humidity, or the cleanliness, and perform an air conditioning operation based on the indoor environment information. If an object is not identified during a threshold time and then an object is identified, it is determined that an object that was absent returned, and the processor 120 may provide the current indoor environment information, and suggest optimal driving based on the indoor environment information. For example, in case the indoor temperature is high compared to the outdoor temperature, the processor 120 may suggest a low desired temperature or suggest that the air conditioning device 100 operates in a general mode but not a windless mode. Alternatively, if the indoor cleanliness is identified as a bad state, the processor 120 may suggest a clean mode for improvement of the indoor air quality.

Figure 3:
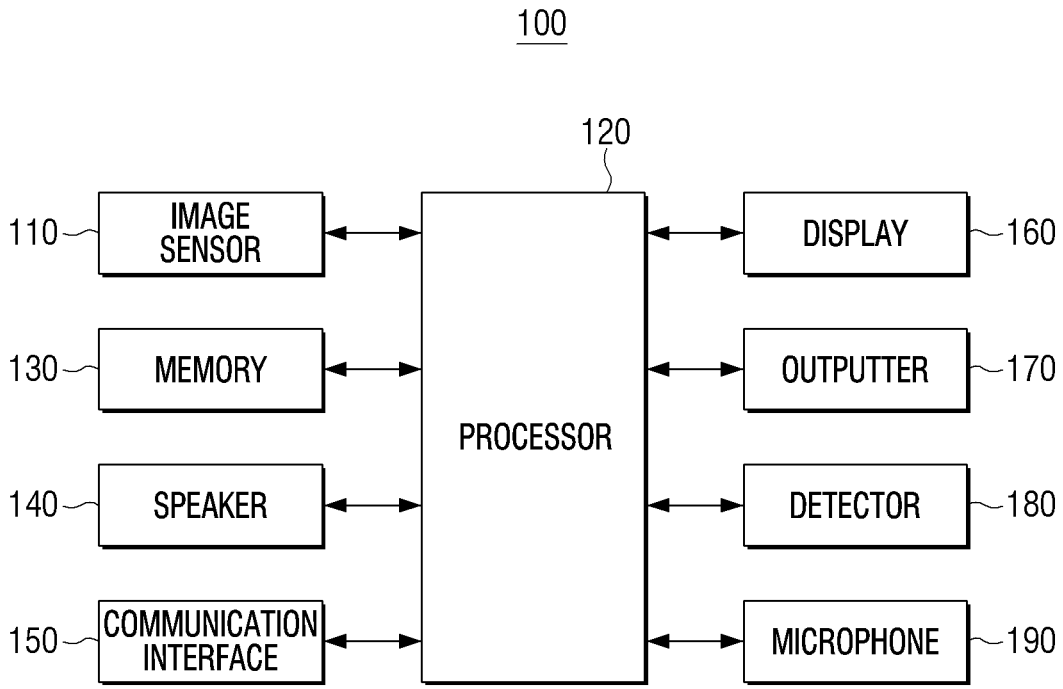
FIG. 3 is a diagram for illustrating a detailed configuration of an air conditioning device according to an embodiment of the disclosure.

FIG. 3 is a diagram for illustrating a detailed configuration of the air conditioning device according to an embodiment of the disclosure.

Referring to FIG. 3, the air conditioning device 100 includes the image sensor 110, the processor 120, a memory 130, a speaker 140, a communication interface 150, a display 160, an outputter 170, a detector 180, and a microphone 190. Among the components illustrated in FIG. 3, regarding parts that overlap with the components illustrated in FIG. 2, detailed explanation will be omitted.

The processor 120 controls the overall operations of the air conditioning device 100 by using various kinds of programs stored in the memory 130.

The processor 120 includes a random access memory (RAM), a read-only memory (ROM), a main CPU, first to nth interfaces, and a bus. The RAM, the ROM, the main CPU, and the first to nth interfaces may be connected with one another through the bus.

In the ROM, a set of instructions for system booting, etc., are stored. When a turn-on instruction is input and power is supplied, the main CPU copies the O/S stored in the memory 130 in the RAM according to the instruction stored in the ROM, and boots the system by executing the O/S. When booting is completed, the main CPU copies various kinds of application programs stored in the memory 130 in the RAM, and performs various kinds of operations by executing the application programs copied in the RAM.

The main CPU accesses the memory 130, and performs booting by using the O/S stored in the memory 130. Then, the main CPU performs various operations by using various kinds of programs, contents, data, etc., stored in the memory 130.

The first to nth interfaces are connected with the aforementioned various kinds of components. One of the interfaces may be a network interface connected with an external device through a network.

The memory 130 may be implemented in the form of a memory embedded in the air conditioning device 100, or in the form of a memory that can be attached to or detached from the air conditioning device 100, according to the usage of stored data. For example, in the case of data for operating the air conditioning device 100, the data may be stored in a memory embedded in the air conditioning device 100, and in the case of data for the extended function of the air conditioning device 100, the data may be stored in a memory that can be attached to or detached from the air conditioning device 100. In the case of a memory embedded in the air conditioning device 100, the memory may be implemented as at least one of a volatile memory (e.g.: a dynamic RAM (DRAM), a static RAM (SRAM) or a synchronous dynamic RAM (SDRAM), etc.) or a non-volatile memory (e.g.: a one time programmable ROM (OTPROM), a programmable ROM (PROM), an erasable and programmable ROM (EPROM), an electrically erasable and programmable ROM (EEPROM), a mask ROM, a flash ROM, a flash memory (e.g.: NAND flash or NOR flash, etc.), a hard drive, or a solid state drive (SSD)). In the case of a memory that can be attached to or detached from the air conditioning device 100, the memory may be implemented in a form such as a memory card (e.g., compact flash (CF), secure digital (SD), micro secure digital (Micro-SD), mini secure digital (Mini-SD), extreme digital (xD), a multi-media card (MMC), etc.) and an external memory that can be connected to a universal serial bus (USB) port (e.g., a USB memory), etc.

According to an embodiment of the disclosure, the memory 130 may store a neural network model trained to identify the type of an object based on an input image. Also, the memory 130 may store priority information for the type information of an object. In addition, the memory 130 may store an image acquired from the image sensor 110.

The speaker 140 is a component outputting not only various kinds of audio data but also various kinds of notification sounds or voice messages. In particular, the speaker 140 may output indoor environment information including at least one of the temperature, the humidity, or the cleanliness. Also, the speaker 140 may output information suggesting optimal driving based on the indoor environment information according to control of the processor 120. For example, the speaker 140 may provide a voice such as "Would you like to set the desired temperature to 23 degrees, and turn on the clean mode?". As described above, the speaker 140 may provide the driving information, the optimal driving information, the indoor environment information, etc., of the air conditioning device 100 through a voice.

The communication interface 150 including circuitry is a component that can communicate with an external device (not shown). Specifically, the communication interface 150 may transmit identification information and a control signal of the air conditioning device 100 to an external device, or receive identification information and a control signal of an external device from the external device. The identification information may include the unique identification number, identification title, serial number, product name, information of the manufacturer, etc., of each device. As described above, a control command is transmitted and received through a network among devices, and the Internet of Things may be performed.

The communication interface 150 may include a Wi-Fi module (not shown), a Bluetooth module (not shown), an infrared (IR) module, a local area network (LAN) module, a wireless communication module (not shown), etc. Each communication module may be implemented in the form of at least one hardware chip. A wireless communication module may include at least one communication chip that performs communication according to various wireless communication protocols such as Zigbee, Ethernet, a USB, a Mobile Industry Processor Interface Camera Serial Interface (MIPI CSI), 3rd generation (3G), 3rd generation partnership project (3GPP), Long Term Evolution (LTE), LTE Advanced (LTE-A), 4th Generation (4G), 5th Generation (5G), etc., other than the aforementioned communication methods. However, this is merely an example, and the communication interface 150 may use at least one communication module among various communication modules.

Meanwhile, the communication interface 150 may receive an image including edge information from an external device. Alternatively, the communication interface 150 may receive an image not including edge information from an external device, and the processor 120 may acquire an image including edge information through edge detection from the received image. In this case, the air conditioning device 100 may not separately include an image sensor 110.

Meanwhile, the communication interface 150 may perform communication with an external device not only through the aforementioned wireless communication methods but also through wired communication methods.

The display 160 is a component displaying various contents or information. In particular, the display 160 may display driving information including the desired temperature, the air conditioning mode, etc. Also, the display 160 may display indoor environment information including the current temperature, humidity, and cleanliness information.

The display 160 may be implemented as displays in various forms such as a liquid crystal display (LCD), organic light-emitting diodes (OLED), Liquid Crystal on Silicon (LCoS), Digital Light Processing (DLP), a quantum dot (QD) display panel, quantum dot light-emitting diodes (QLED), micro light-emitting diodes (micro LED), etc.

The display 160 may be implemented in the form of a touch screen constituting an interlayer structure with a touch pad. The touch screen may be constituted to detect the pressure of a touch input as well as the location and the area of a touch input.

The outputter 170 is a component outputting wind through a wind door. Wind may be wind for cooling or heating. The outputter 170 may include a fan generating air currents for outputting wind. A fan may be constituted as one or a plurality of fans.

The detector 180 is a component detecting indoor environment information. For example, the detector 180 may detect a temperature, humidity, and dust concentration. Also, the detector 180 may be respectively implemented as a temperature sensor, a humidity sensor, and a fine dust sensor.

A fine dust sensor may sense fine dusts of PM 10, PM 2.5, and PM 1.0 depending on types, but is not limited thereto.

The microphone 190 is a component acquiring a voice signal of a speaker. A voice signal received through the microphone 190 may be converted into text information through a voice recognition module and information on the intent of the speaker may thereby be identified. For example, in case a voice "Set the desired temperature as 18 degrees" is received through the microphone 190, information on the intent of the speaker may be identified through a voice recognition process, and the desired temperature of the air conditioning device 100 may be changed to 18 degrees.

Meanwhile, the microphone 190 may be included in not only the air conditioning device 100 but also a remote control device remotely controlling the air conditioning device 100.

Figure 4:
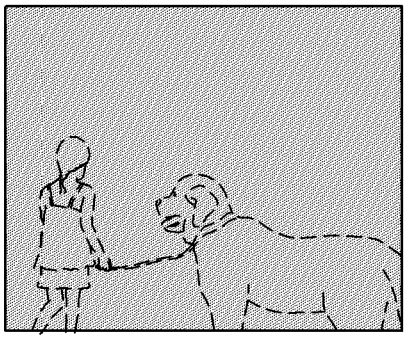
FIG. 4 is a diagram for illustrating an image including edge information according to an embodiment of the disclosure.

FIG. 4 is a diagram for illustrating an image including edge information according to an embodiment of the disclosure.

An image including edge information is an image including only the contour lines of an object, and it may be a binary image.

Referring to FIG. 4, the background of an image including edge information may be in a black color, and only the contour lines of an object may be displayed in a white color.

According to an embodiment of the disclosure, an image including edge information may be generated through a dynamic vision sensor (DVS) that is a sensor detecting an edge area of an object based on a light reflected from the object according to a movement of the object. In this case, the air conditioning device 100 may acquire information on objects from an image including edge information acquired from the image sensor 110 without a separate processing process. Information on objects may include at least one of the types of the objects, the number of the objects, the sizes of the objects, the amount of activity of the objects, or the locations of the object.

According to another embodiment of the disclosure, if an image not including edge information is acquired through a complementary metal oxide semiconductor (CMOS) sensor, the air conditioning device 100 may perform edge detection processing from the acquired image. For example, in case different contrasts are included based on a boundary line within an acquired image and the brightness of pixels is changed to be greater than or equal to a threshold value, the air conditioning device 100 may perform edge detection processing through a method of identifying the boundary line as an edge (a contour line). In other words, the air conditioning device 100 may acquire an image including edge information by performing edge detection processing for an image acquired from the image sensor 110. Afterwards, the air conditioning device 100 may acquire information on objects from the image including edge information.

Figure 6A:
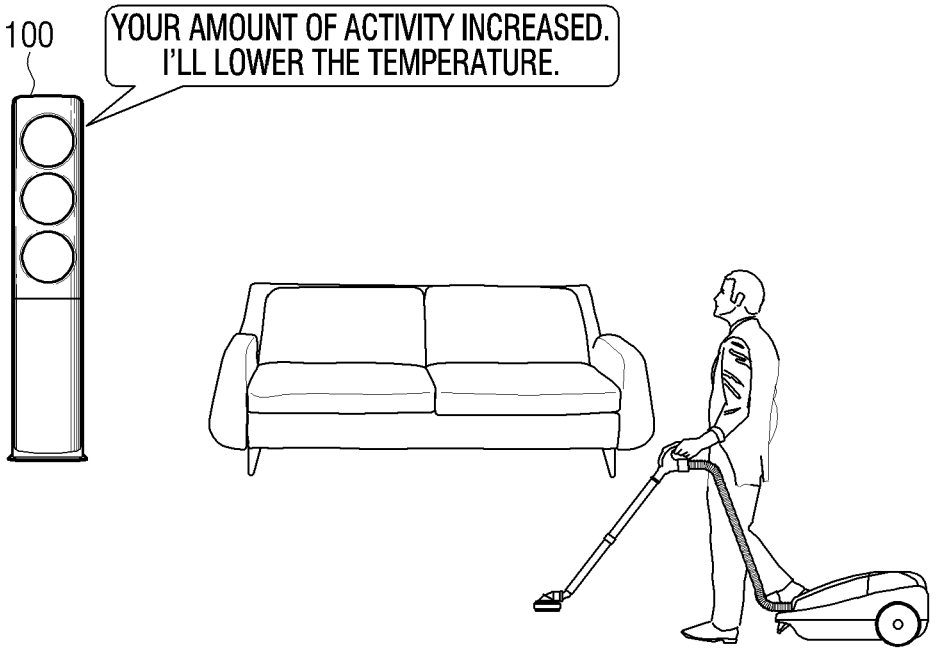
FIG. 6A is a diagram for illustrating control of an air conditioning device in case an amount of activity is relatively a lot according to an embodiment of the disclosure.
Figure 6B:
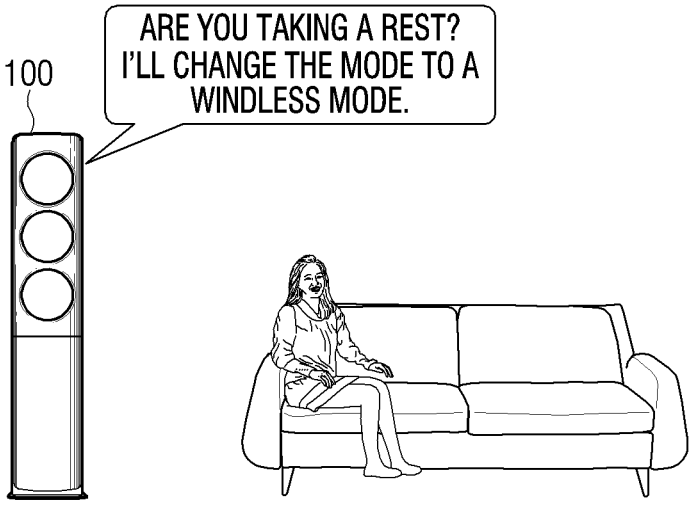
FIG. 6B is a diagram for illustrating control of an air conditioning device in case an amount of activity is relatively little according to an embodiment of the disclosure.
Figure 6C:
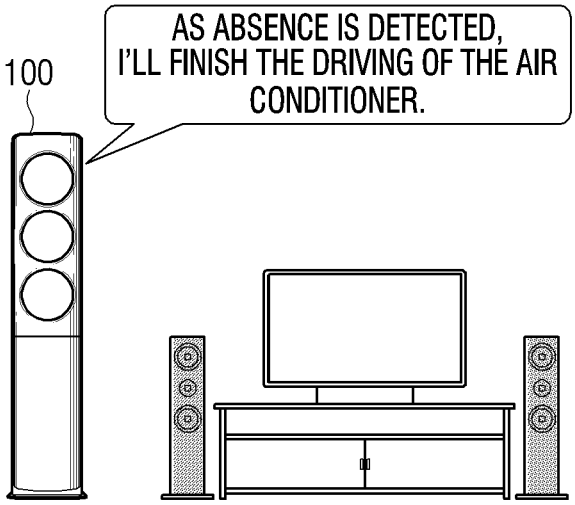
FIG. 6C is a diagram for illustrating control of an air conditioning device in case an amount of activity is not detected according to an embodiment of the disclosure.

FIGS. 6A to 6C are diagrams for illustrating control of an air conditioning device based on information on the amount of activity of an object according to various embodiments of the disclosure.

FIG. 6A is a diagram for illustrating control of an air conditioning device in case an amount of activity is relatively a lot according to an embodiment of the disclosure.

Referring to FIG. 6A, the air conditioning device 100 may acquire information on the amount of activity of an object based on the degree that edges (contour lines) included in an image are changed. As edge information is information generated based on a light reflected from a moving object, if the amount of activity of an object is higher, the degree of change of edges may be bigger. The amount of activity may be distinguished according to a predetermined threshold value, and there may be a plurality of threshold values. For example, information on an amount of activity may be distinguished by a first threshold value and a second threshold value bigger than the first threshold value.

Referring again to FIG. 6A, based on the assumption of a case wherein information on an amount of activity is bigger than the second threshold value will be described.

In this case, the air conditioning device 100 may identify that the amount of activity of an object is relatively big, and suggest a desired temperature that is lower than the set desired temperature. For example, the air conditioning device 100 may provide a voice such as "Your amount of activity increased. I'll lower the temperature" through the speaker 140. Alternatively, the air conditioning device 100 may increase the number of wind doors through which cooled wind is output. For example, in case the number of wind doors through which wind is currently output is one or two, the air conditioning device 100 may output cooled wind through wind doors in a number of three which is the maximum number of wind doors based on information on the amount of activity.

Alternatively, the air conditioning device 100 may acquire information on the amount of activity of an object based on the type information of the object identified from an image. This is because a relatively high amount of activity may be expected through the type information of an identified object. For example, in case a cleaner is identified from an image, the air conditioning device 100 may expect that the amount of activity of a person will be higher, and lower the desired temperature, or increase the number of wind doors. Also, the air conditioning device 100 may determine an air conditioning mode based on the type information of an identified object. For example, in case a cleaner is identified from an image, the air conditioning device 100 may identify that it is currently a cleaning state, and perform a clean mode.

FIG. 6B is a diagram for illustrating control of an air conditioning device in case an amount of activity is relatively little according to an embodiment of the disclosure.

FIG. 6B will be described based on the assumption of a case wherein information on an amount of activity is smaller than the first threshold value.

Referring to FIG. 6B, the air conditioning device 100 may identify that the amount of activity of an object is relatively little, and suggest change of the air conditioning mode. For example, the air conditioning device 100 may provide a voice such as "Are you taking a rest? I'll change the mode to a windless mode" through the speaker 140. Alternatively, the air conditioning device 100 may suggest a desired temperature that is higher than the set desired temperature or decrease the number of wind doors through which cooled wind is output. For example, in case the number of wind doors through which wind is currently output is two or three, the air conditioning device 100 may output cooled wind through one wind door based on information on the amount of activity.

FIG. 6C is a diagram for illustrating control of an air conditioning device in case an amount of activity is not detected according to an embodiment of the disclosure.

Referring to FIG. 6C, the air conditioning device 100 may identify that it is an absence state of an object, and finish the driving of the air conditioning device 100. For example, the air conditioning device 100 may provide a voice such as "As absence is detected, I'll finish the driving of the air conditioner" through the speaker 140. Meanwhile, even if an object is not identified, in case a predetermined sound is received through the microphone 190 provided on the air conditioning device 100, the air conditioning device 100 may identify that the current state is not an absence state, and may not finish the driving of the air conditioning device 100.

Alternatively, if it is identified that it is an absence state of an object, the air conditioning device 100 may first change the air conditioning mode to a windless mode or increase the desired temperature, and in case the absence state of an object is maintained during a predetermined time, the air conditioning device 100 may finish the driving of the air conditioning device 100.

Meanwhile, in case information on an amount of activity is greater than or equal to the first threshold value and smaller than the second threshold value, the air conditioning device 100 may identify the state as a state where information on an amount of activity is general, and maintain the current driving state of the air conditioning device 100.

Figure 7:
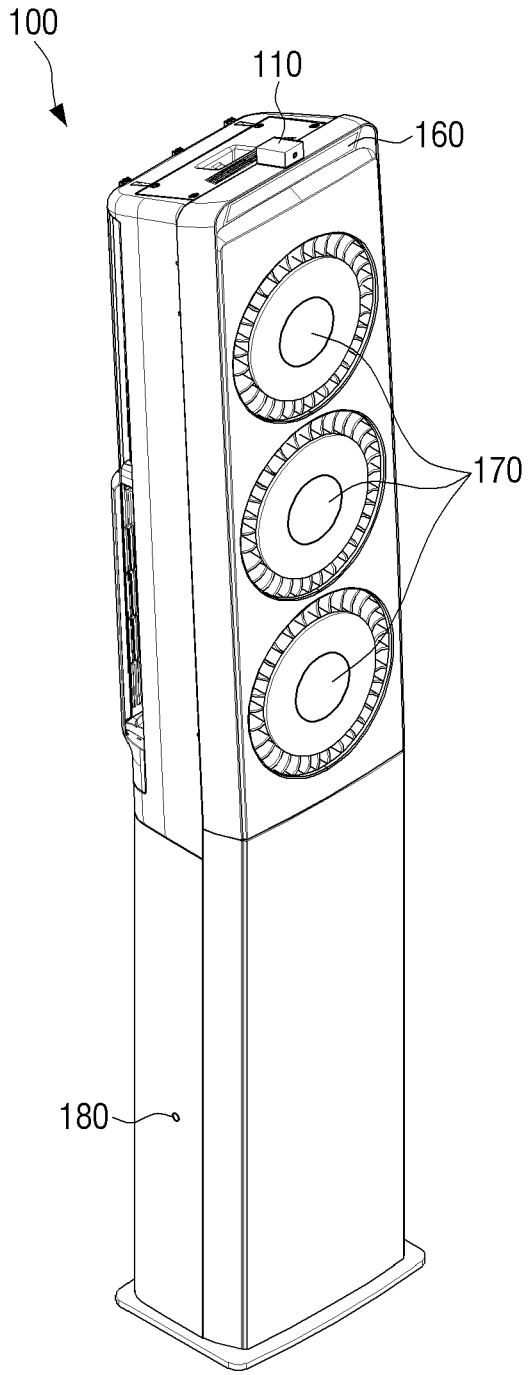
FIG. 7 is a diagram for illustrating physical locations of components included in an air conditioning device according to an embodiment of the disclosure.

FIG. 7 is a diagram for illustrating physical locations of components included in the air conditioning device according to an embodiment of the disclosure.

Referring to FIG. 7, the image sensor 110 may be arranged on the uppermost end of the air conditioning device 100. As the image sensor 110 is a device that acquires an indoor image for identifying information of objects, the image sensor 110 may be arranged on the uppermost end of the air conditioning device 100 such that objects in a far distance can be included in an image.

The display 160 may be arranged in the upper part of the air conditioning device 100. The display 160 is a component displaying various kinds of information, and in case the display 160 is arranged in the upper part, the recognition degree of a user can be improved.

The outputter 170 includes at least one fan generating air currents, and the at least one fan may be provided in the front surface part of the air conditioning device 100. In case the fan is implemented as a plurality of fans, each fan may perform an operation of outputting wind independently according to control of the processor 120.

The detector 180 is a component detecting a temperature, humidity, and dust, and it may be arranged in the lower part of the air conditioning device 100.

The arrangement locations of each component illustrated in FIG. 7 are merely an example, and they can obviously be changed to various forms.

Figure 8:
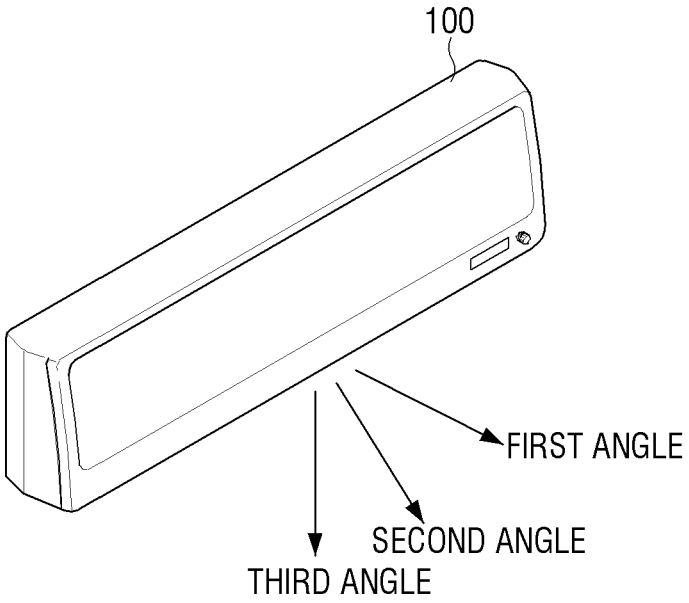
FIG. 8 is a diagram for illustrating a case wherein an air conditioning device is implemented as a wall-mounted air conditioner according to an embodiment of the disclosure.

FIG. 8 is a diagram for illustrating a case wherein the air conditioning device is implemented as a wall-mounted air conditioner according to an embodiment of the disclosure.

Referring to FIG. 8, it was described above that the air conditioning device 100 is implemented as a stand-type air conditioner and provides cooling to a requested cooling space by adjusting the number of wind doors providing cooled wind based on information on objects, but an embodiment of providing cooling to a requested cooling space in case the air conditioning device 100 is implemented as a wall-mounted air conditioner is described.

As an example, in case the type information of an object identified from an image including edge information is a person, the air condition device 100 may output cooled wind at a first angle which is a relatively high angle such that wind reaches the upper space of the indoor space based on the actual living space of the person.

As another example, in case an object identified from an image including edge information is a large-sized dog, the air conditioning device 100 may output cooled wind at a second angle based on the actual living space of the large-sized dog.

As still another example, in case an object identified from an image including edge information is a small-sized dog, the air conditioning device 100 may output cooled wind at the second angle which is a relatively low angle such that wind reaches the lower space of the indoor space swiftly based on the actual living space of the small-sized dog.

As described above, by adjusting an angle at which wind is output to correspond to each object, an object may be provided with a cooling effect swiftly.

Figure 9:
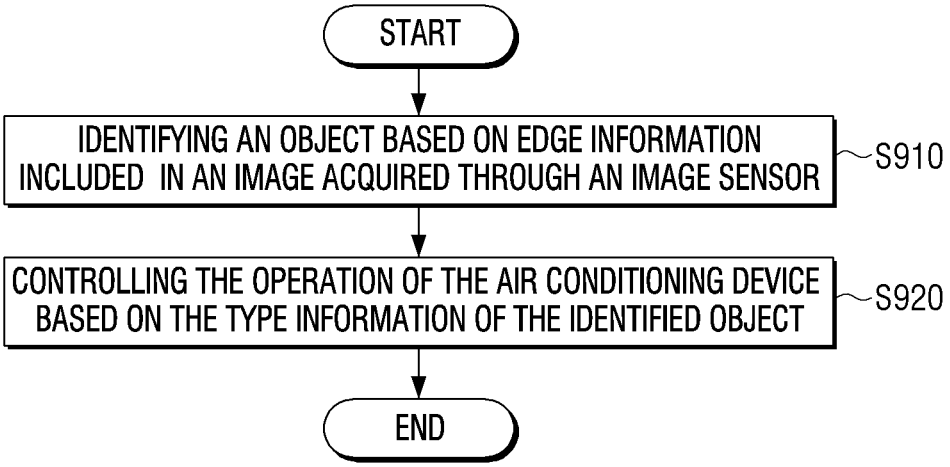
FIG. 9 is a flow chart for illustrating a control method of an air conditioning device according to an embodiment of the disclosure.

FIG. 9 is a flow chart for illustrating a control method of an air conditioning device according to an embodiment of the disclosure.

The air conditioning device 100 may identify an object based on edge information included in an image acquired through the image sensor 110 at operation S910.

Referring to FIG. 9, the image sensor 110 may be implemented as a dynamic vision sensor (DVS) that is a sensor detecting an edge area by identifying a movement of an object based on a light reflected from the object. In other words, an image detected from a DVS is a binary image, and it may be an image including edge information.

According to another embodiment of the disclosure, the air conditioning device 100 may detect an edge area in an image acquired through the image sensor 110, and acquire edge information based on the detected edge area. In other words, an image acquired from the image sensor 110 is an image not including edge information, but an image including edge information may be acquired from the image through post-processing of the air conditioning device 100.

The air conditioning device 100 may control the operation of the air conditioning device 100 based on the type information of an identified object at operation S920.

Specifically, the air conditioning device 100 may input an image acquired from the image sensor 110 into a prestored neural network model trained to identify types of objects based on an input image, and control the operation of the air conditioning device based on the type information of an object output from the neural network model. In other words, the air conditioning device 100 may acquire type information of an object through information output from a neural network model.

The air conditioning device 100 may control at least one of an air conditioning mode or the strength of air conditioning based on the type information of an object. As an example, the air conditioning device 100 may control at least one of a cooling mode or a heating mode, the strength of wind for cooling or heating, the location of wind for cooling or heating, or the angle of wind for cooling or heating based on the type information of an object.

The air conditioning device 100 may acquire additional information for at least one of the number of objects, the sizes of objects, the amount of activity of objects, or the locations of objects based on an image acquired from the image sensor 110, and control the operation of the air conditioning device 100 based on the type information of objects and the additional information.

Meanwhile, if objects of the first type and objects of the second type having different priorities are identified from the acquired image, the air conditioning device 100 may control the conditioning operation based on the first type having the relatively high priority.

Meanwhile, if an object is not identified during a threshold time and then an object is identified, the air conditioning device 100 may output indoor environment information including at least one of the temperature, the humidity, or the cleanliness, and perform an air conditioning operation based on the indoor environment information.

Meanwhile, methods according to the aforementioned various embodiments of the disclosure may be implemented in forms of applications that can be installed on electronic devices (air conditioning devices).

Also, methods according to the aforementioned various embodiments of the disclosure may be implemented only with software upgrade, or hardware upgrade of electronic devices (air conditioning devices).

In addition, it is possible that the aforementioned various embodiments of the disclosure are performed through an embedded server provided on an electronic device, or at least one external server of an electronic device.

Meanwhile, according to an embodiment of the disclosure, the various embodiments described above may be implemented as software including instructions stored in machine-readable storage media, which can be read by machines (e.g.: computers). The machines refer to devices that call instructions stored in a storage medium, and can operate according to the called instructions, and the devices may include the electronic device according to the aforementioned embodiments. In case an instruction is executed by a processor, the processor may perform a function corresponding to the instruction by itself, or by using other components under its control. An instruction may include a code that is generated or executed by a compiler or an interpreter. A storage medium that is readable by machines may be provided in the form of a non-transitory storage medium. The term 'non-transitory' only means that a storage medium does not include signals, and is tangible, but does not indicate whether data is stored in the storage medium semi-permanently or temporarily.

Also, according to an embodiment of the disclosure, methods according to the aforementioned various embodiments of the disclosure may be provided while being included in a computer program product. A computer program product refers to a product, and it can be traded between a seller and a buyer. A computer program product can be distributed on-line in the form of a storage medium that is readable by machines (e.g.: a compact disc read only memory (CD-ROM)), or through an application store (e.g.: play store TM). In the case of on-line distribution, at least a portion of a computer program product may be stored in a storage medium such as the server of the manufacturer, the server of the application store, and the memory of the relay server at least temporarily, or may be generated temporarily.

In addition, according to an embodiment of the disclosure, the various embodiments of the disclosure described above may be implemented in a recording medium that is readable by a computer or a device similar thereto, by using software, hardware or a combination thereof. In some cases, the embodiments described in this specification may be implemented as a processor itself. According to implementation by software, the embodiments such as procedures and functions described in this specification may be implemented as separate software modules. Each of the software modules may perform one or more functions and operations described in this specification.

Meanwhile, computer instructions for executing the processing operations of the device according to the aforementioned various embodiments of the disclosure may be stored in a non-transitory computer readable medium. Such computer instructions stored in a non-transitory computer readable medium may make the processing operations according to the aforementioned various embodiments performed by a specific machine, when they are executed by a processor.

A non-transitory computer-readable medium refers to a medium that stores data semi-permanently, and is readable by machines, but not a medium that stores data for a short moment such as a register, a cache, and a memory. As specific examples of a non-transitory computer-readable medium, there may be a CD, a DVD, a hard disc, a blue-ray disc, a USB, a memory card, an ROM and the like.

Also, each of the components according to the aforementioned various embodiments (e.g.: a module or a program) may consist of a singular object or a plurality of objects. Also, among the aforementioned corresponding sub components, some sub components may be omitted, or other sub components may be further included in the various embodiments. Alternatively or additionally, some components (e.g.: a module or a program) may be integrated as an object, and perform the functions that were performed by each of the components before integration identically or in a similar manner A module, a program, or operations performed by other components according to the various embodiments may be executed sequentially, in parallel, repetitively, or heuristically. Or, at least some of the operations may be executed in a different order or omitted, or other operations may be added.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An air conditioning device comprising:

an image sensor; and a processor configured to:

identify an object based on edge information included in an image obtained by the image sensor, identify type information indicating that a type of the identified object is a person or an animal, identify size information of the identified object, and control an air conditioning mode and a strength of air conditioning of the air conditioning device based on the type information of the identified object and the size information of the identified object, wherein the air conditioning mode and the strength of air conditioning are changed based on the type information of the identified object and the size information of the identified object, and wherein the processor is further configured to control an angle of a wind for a cooling mode or a heating mode based on the type information of the identified object and the size information of the identified object.

2. The air conditioning device of claim 1, wherein the air conditioning device is implemented as an air conditioner, and wherein the processor is further configured to:

control at least one of the cooling mode or the heating mode, a strength of wind for the cooling mode or the heating mode, a location of wind for the cooling mode or the heating mode based on the type information of the identified object and the size information of the identified object.

3. The air conditioning device of claim 1, wherein the image sensor comprises a sensor that detects an edge area by identifying a movement of the identified object based on a light reflected from the identified object.

4. The air conditioning device of claim 3, wherein the image sensor further comprises a dynamic vision sensor (DVS) detecting the edge area.

5. The air conditioning device of claim 1, further comprising:

a memory storing a neural network model trained to identify a type of the identified object based on an input image, wherein the processor is further configured to:

input the input image into the neural network model, and control the air conditioning mode and the strength of air conditioning of the air conditioning device based on the type information of the identified object and the size information of the identified object output from the neural network model.

6. The air conditioning device of claim 1, wherein the identified object is at least one of a number of objects, and wherein the processor is further configured to:

obtain additional information for the at least one of the number of objects, sizes of the at least one of the number of objects, an amount of activity of the at least one of the number of objects, or locations of the at least one of the number of objects based on the obtained image, and control the air conditioning mode and the strength of air conditioning of the air conditioning device based on the type information and the size information of the at least one of the number of objects and the additional information.

7. The air conditioning device of claim 1, further comprising:

a speaker, wherein the processor is further configured to:

based on the identified object not being identified during a threshold time and then the object being identified, control the speaker to output indoor environment information including at least one of a temperature, a humidity, or a cleanliness, and perform the air conditioning mode and the strength of air conditioning of the air conditioning device based on the indoor environment information.

8. The air conditioning device of claim 1, wherein the type information of the identified object comprises a first type and a second type having different priorities, and wherein the processor is further configured to:

based on the identified object of the first type and the identified object of the second type being identified in the image, control the air conditioning mode and the strength of air conditioning of the air conditioning device based on the first type having a relatively higher priority.

9. The air conditioning device of claim 1, wherein the image is a binary image.

10. The air conditioning device of claim 1, wherein the processor is further configured to:

detect an edge area in an image obtained by the image sensor, and obtain the edge information based on the detected edge area.

11. A control method of an air conditioning device, the method comprising:

identifying an object based on edge information included in an image obtained by an image sensor;

identifying type information indicating that a type of the identified object is a person or an animal;

identifying size information of the identified object; and controlling an air conditioning mode and a strength of air conditioning of the air conditioning device based on the type information of the identified object and the size information of the identified object, wherein the air conditioning mode and the strength of air conditioning are changed based on the type information of the identified object and the size information of the identified object, and wherein the controlling comprises controlling an angle of a wind for a cooling mode or a heating mode based on the type information of the identified object and the size information of the identified object.

12. The control method of claim 11, wherein the controlling comprises:

controlling at least one of the cooling mode or the heating mode, a strength of wind for the cooling mode or the heating mode, a location of the wind for the cooling mode or the heating mode based on the type information of the identified object and the size information of the identified object.

13. The control method of claim 11, wherein the image sensor comprises a sensor configures to detect an edge area by identifying a movement of the identified object based on a light reflected from the identified object.

14. The control method of claim 13, wherein the image sensor comprises a dynamic vision sensor (DVS) detecting the edge area.

15. The control method of claim 11, wherein the controlling comprises:

inputting the obtained image into a prestored neural network model trained to identify a type of an object based on an input image, and controlling the air conditioning mode and the strength of air conditioning of the air conditioning device based on the type information of the identified object and the size information of the identified object output from the prestored neural network model.

16. The control method of claim 11, wherein the identified object is at least one of a number of objects, and wherein the controlling comprises:

obtaining additional information for at least one of a number of objects, sizes of the at least one of the number of objects, an amount of activity of the at least one of the number of objects, or locations of the at least one of the number of objects based on the obtained image; and controlling the air conditioning mode and the strength of air conditioning of the air conditioning device based on the type information and the size information of the at least one of the number of objects and the additional information.

17. The control method of claim 11, further comprising:

based on the identified object not being identified during a threshold time and then the identified object being identified, outputting indoor environment information including at least one of a temperature, a humidity, or a cleanliness; and performing the air conditioning mode and the strength of air conditioning of the air conditioning device based on the indoor environment information.

18. The control method of claim 11, wherein the type information of the identified object includes a first type and a second type having different priorities, and wherein the controlling further comprises:

based on the identified object of the first type and the identified object of the second type being identified in the image, controlling the air conditioning mode and the strength of air conditioning of the air conditioning device based on the first type having a relatively higher priority.

* * * * *